United States Patent [19]

McPherson et al.

[11] Patent Number: 4,724,889

[45] Date of Patent: Feb. 16, 1988

[54] DEGATING TECHNIQUE FOR CLUSTERED CASTINGS MADE BY ECP

[75] Inventors: James C. McPherson, Windsor, Canada; William C. Priestley, Farmington Hills; Duane E. Becknell, Farmington, both of Mich.

[73] Assignee: Ford Motor Company, Dearborn, Mich.

[21] Appl. No.: 42,773

[22] Filed: Apr. 27, 1987

[51] Int. Cl.[4] ..... B22C 9/04; B22D 31/00

[52] U.S. Cl. ..... 164/34; 164/70.1

[58] Field of Search ..... 164/34, 35, 36, 69.1, 164/70.1

[56] References Cited

U.S. PATENT DOCUMENTS

| | | | |
|---|---|---|---|
| 1,945,358 | 1/1934 | Raible | 164/70.1 X |
| 3,374,824 | 7/1965 | Snelling . | |
| 3,627,023 | 12/1971 | Clark et al. | 164/70.1 X |
| 3,868,986 | 3/1975 | Olsen . | |

*Primary Examiner*—Kuang Y. Lin

*Attorney, Agent, or Firm*—Joseph W. Malleck; Roger L. May

[57] ABSTRACT

A method is disclosed of degating clustered metal castings produced by ECP in which molten metal is gravity poured into a dry, unbonded sand mold for solidification, the mold containing a plurality of consumable foam patterns interconnected by a complex centralized gating system. The method is improved by forcing purge air through the unbonded sand mold just prior to the solidification of the core metal of the gating system, the purge air being forced into such mold at a predetermined pressure (such as 80–120 psi) and for a period of time (such as 10–20 seconds), causing the gating system to disintegrate into pieces or beads of metal. The elapsed period of time from the moment of pouring the molten metal into the mold to the moment at which the purge air is injected into the mold is critical and for certain metals is usually in the range of 3–5.7 minutes.

11 Claims, 11 Drawing Figures

Cluster invested in a flask of sand.

Molten aluminum starts to vaporize the foam cluster.

Vaporization continues.

The cluster is 90% vaporized as the metal continues to feed from the funnel.

Vaporization is complete.

The foam is totally displaced by molten metal.

Solidification starts from areas most remote from the ingates.

Directional solidification continues towards the ingates.

The part is totally solidified.

Portions of the gating and all of the downsprue are still molten or mushy.

Air is injected into the flask to fluidize the sand.

Disturbance of the sand causes the solidified parts to move away from the gating system.

The downsprue and runners are fragmented and dumped as small chunks.

10–20 PSI in chamber

DEGATING TECHNIQUE FOR CLUSTERED CASTINGS MADE BY ECP

BACKGROUND OF THE INVENTION

1. Technical Field

This invention relates to the art of making castings using a consumable pattern, commonly called the evaporative casting process (ECP), employing unbonded sand as the molding medium. This invention also relates, more particularly, to the technology for removing the solidified gating system attached to the metal casting.

2. Description of the Prior Art

ECP has become one of the major commerical innovations introduced recently by the foundry industry. It employs a consumable pattern made, typically, of polystyrene foam material in substantially the exact shape of the casting to be produced plus the shape of the sprue and runners forming the gating system within the mold for such casting. One of the great attributes of this process is the ability to embed the pattern in dry, unbonded sand (which may be fluidized by air followed by vibration to lock the sand grains in place about the pattern). There is no concern for a mold parting line or a pattern draft. The pattern material is ignited by poured molten metal, oxidized, and replaced by solid metal. The vaporized products of the pattern migrate outwardly through the interstices of the dry, unbonded sand.

Use of dry, unbonded sand allows the pattern design to be more complex and permits clustering of several castings about a common sprue (see U.S. Pat. Nos. 3,374,824 and 3,868,986 depicting simple, elementary, early versions of this concept). Clustering encourages closer positioning of the casting replicas relative to the central sprue to reduce temperature losses and metal return. In a large design, such as for an automobile manifold, the resulting cluster of castings will look like a tree with intricate branches projecting radially outwardly therefrom, creating a complex labyrinth of metal arms. The arms are usually the several runners leading to ingates at several locations along the casting replica.

The earliest mode used to separate the castings from the mold medium was to simply dump the entire contents of a mold flash onto a screen, the sand passing through the screen from the cluster of castings. The casting cluster was degated by cutting through the gating system labyrinth with a torch. In complex clusters, there is little access to a desired severance location, so time-consuming preliminary torch cuts must be made first. When access is provided, the final torch cuts are made at the juncture of the runner and usable casting. Because the complexity of the gating system prevents access of the torch to the innermost locations that must be severed, the cost of degating is increased and automation of such procedure is inhibited.

Accordingly, a primary object of this invention is to modify the solidification process of ECP so that much of the gating is easily disintegrated, allowing the casting to be removed as distinct, severed units. This would enable close, accurate, and robotic torch cutting of any residual gating; in the alternative, achieving disintegration would also allow simple impact severance of the residual gating without the need for torch cutting.

SUMMARY OF THE INVENTION

The invention herein contemplates achieving such object by forcing cooling purge air through the dry, unbonded sand at precise timing, the moment being chosen to be just prior to the solidification of the gating system for disintegrating the gating system. The discrete castings are thus separated from the common gating tree.

More particularly, the invention is a method of degating clustered metal castings produced by ECP in which molten metal is gravity poured into a dry, unbonded sand mold for solidification, the improvement comprising: forcing purge air through the unbonded sand mold just prior to the solidification of the core metal of said gating, said purge air being forced thereinto at a predetermined pressure and for a period of time causing the gating system to disintegrate, preferably into solid beads of metal. The method may further comprehend roughly separating the castings from the gating complex and then severing any residual gating studs from each casting.

Preferably, the purge air is cool, such as room temperature, and is applied at a pressure of about 80–120 psi for 10–20 seconds. The molten metal is preferably aluminum and poured at a temperature of 1400°–1460° F. The time period from pour to purge is advantageously 3–5 minutes, but such time period can be adjusted to ensure only ⅝ inch solidified gating protrusion before and after purging.

DETAILED DESCRIPTION AND BEST MODE

This invention accomplishes severance of the casting from the sprue while the casting cluster is still in the mold. After metal pouring, solidification of the metal takes place directionally from the coolest zones of the casting, usually the furthest from the ingates, toward the interior gating and central downsprue. Thermocouple studies have confirmed that a metal casting, such as a seven pound aluminum engine manifold, is solidified in approximately two minutes while the sprue can take as long as 10 minutes to solidify. With the improved process of this invention, the poured molds can be conveyed to a sand conditioning station whereupon, while only the core metal of the gating system is still molten, the mold material is air fluidized. The time period after pour to air purge must be carefully controlled to coincide with the solidification front having proceeded only as far as the exit of the gating system. At this moment, relatively cool purge air (room temperature) is forced up through the mold, the castings will be severed from the sprue by disintegration of the gating system. The contents of the molding flask is then dumped onto a screen separator for extracting the usable castings from the sand and disintegrated gating. The castings can easily be either milled or saw cut to desired shape. To reduce the nondisintegrated gating stubs projecting from the casting, the consumable patterns may be provided with shallow annular notches located at a desired cleavage plane, preferably coinciding with a finished surface of the casting. Thus, the gating upstream of such notches is more readily removed by sand fluidization or by manual impact after separation from the sand. Alternatively, fiberglass screens may be implanted at such locations to facilitate cleavage by manual impact after separation, again reducing nondisintegrated gating stubs to a minimum and thereby requiring little or no torch cutting with additional savings in cost and manpower.

The advantages of such system comprise: (a) the parts are automatically declustered; (b) sand conditioning is more effective because it can take place immediately subsequent at a higher temperature; (c) fewer flasks are required on the mold line because the patterns can be clustered closer together with a flask without fear of impeding a torch severance sequence; and (d) casting yield can be improved because the clusters no longer have to be arranged to accommodate plasma or torch cutting allowing castings to be multiplied and arranged closer together within a given mold size.

Mold Preparation

Figure 1:
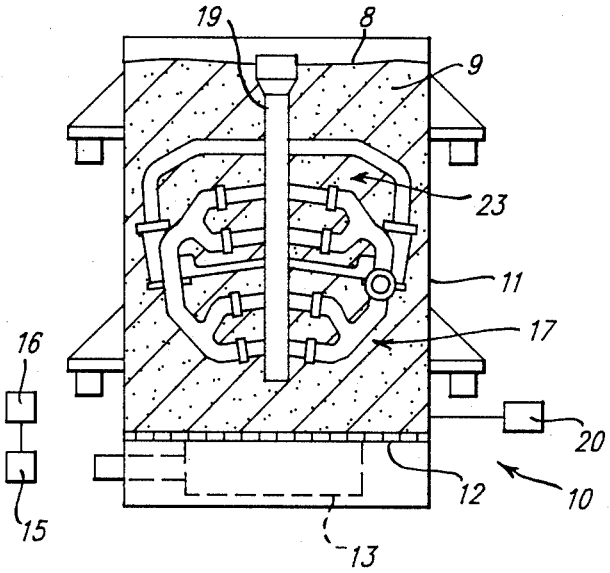
FIGS. 1–10 are sequential schematic views of the method of this invention, each showing a central sectional view of a flask with embedded consumable patterns therein for carrying out ECP and illustrating the sequence of solidification and gating disintegration.
Figure 11:
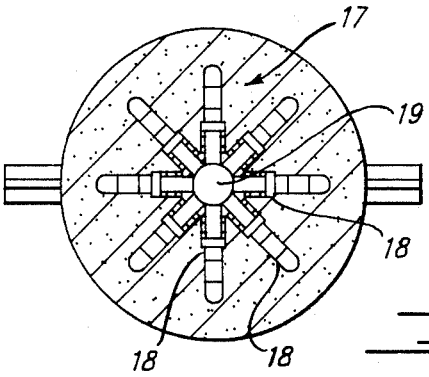
FIG. 11 is a sectional view taken substantially along line 11—11 of FIG. 2.

As shown in FIG. 1, a flask 10 for the ECP process is preferably comprised of a cast iron cylinder 11 with a bottom plate 12 perforated generally throughout at least a central zone, at least above an air manifold 13. The perforated plate is thus in communication with the air manifold 13 which can receive air from an air supply when connected thereto. The preformed foam pattern clusters 17 are suspended within the interior of the flask, preferably by use of a robotic device. The pattern cluster, particularly as shown in FIG. 11, has eight manifold patterns 18 radiating from the common sprue 19, each equi-spaced at about a 45° angle thereabout. It is contemplated that 10–12 such manifolds could be arranged as radii of such sprue 19. This is a significant improvement over patterns that were limited to 90° angles or more therebetween (characteristic of the prior art) to facilitate access of a torch for severance of the solidified gating. One or more injection tubes (not shown) are lowered into the flask to about the mid-height of the pattern cluster; dry, unbonded sand 9 is injected through the tubes to fill the interior of such flask to a level 8. The sand flows through the tubes by gravity or can be forced therethrough by pneumatic assist. The tubes are automatically raised as the level of sand begins to rise within the flask; sand will thereby be introduced into all the interstices between the patters. Upon withdrawal of the sand fill tubes and completion of the sand filling operation, the flask is vibrated by auxiliary equipment 20; the irregular, sharp sand grains will be locked into place and settled. The robotic holding device for the pattern assembly is then removed. The sand should be packed consistently with sufficient density to ensure proper chill for the cast metal on a repeatable basis.

Pouring and Solidification

Figure 2:
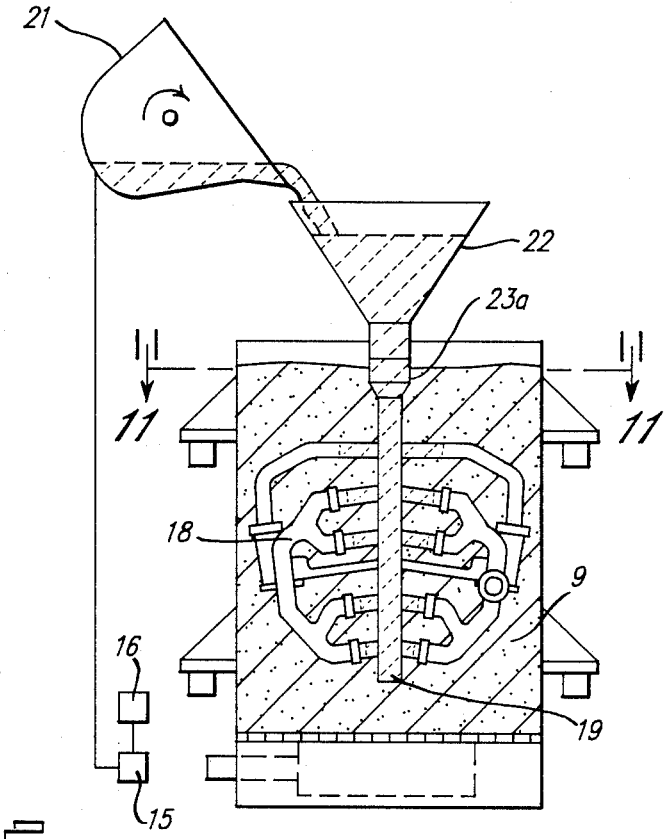
Figure 3:
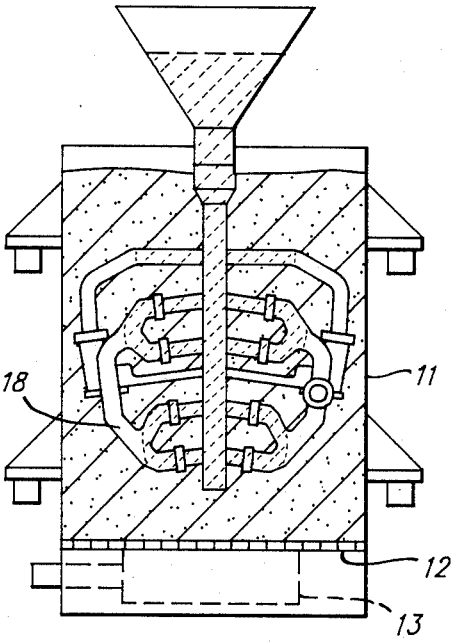
Figure 4:
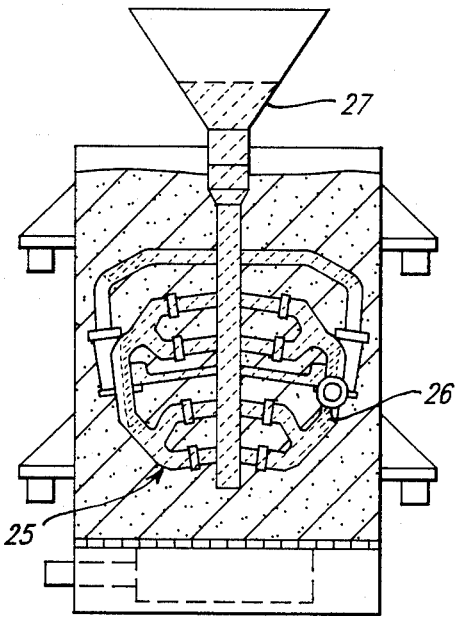
Figure 5:
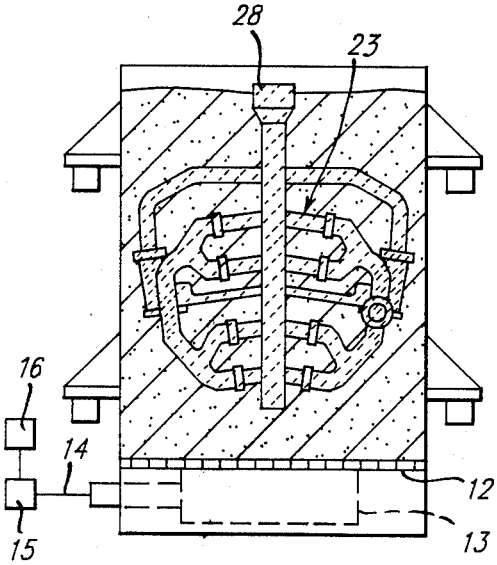
Figure 6:
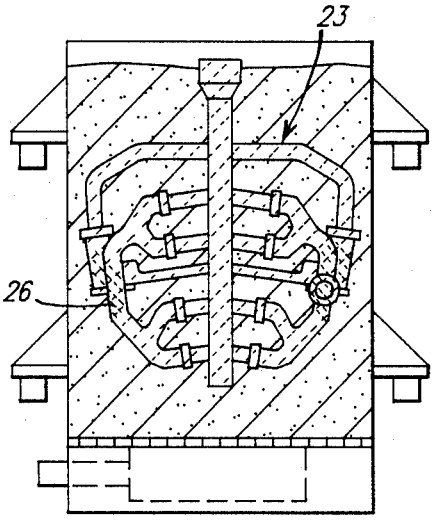
Figure 7:
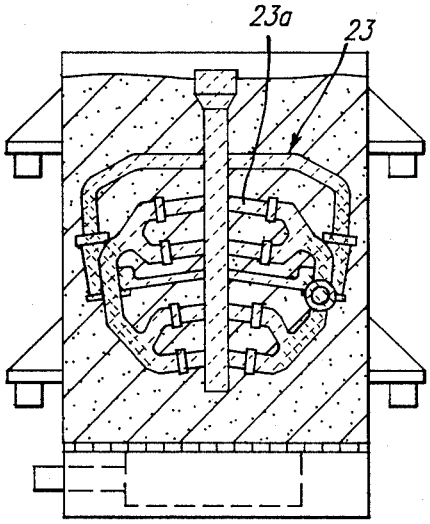
Figure 8:
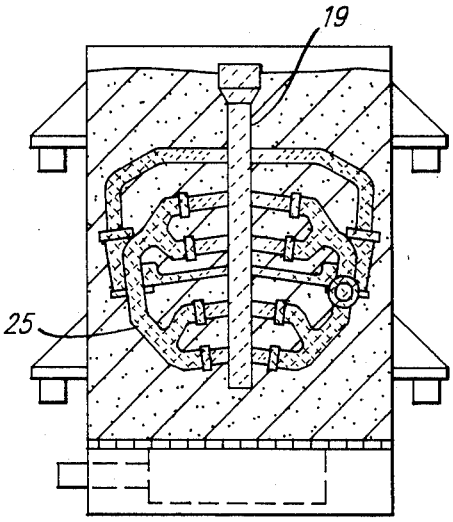
Figure 9:
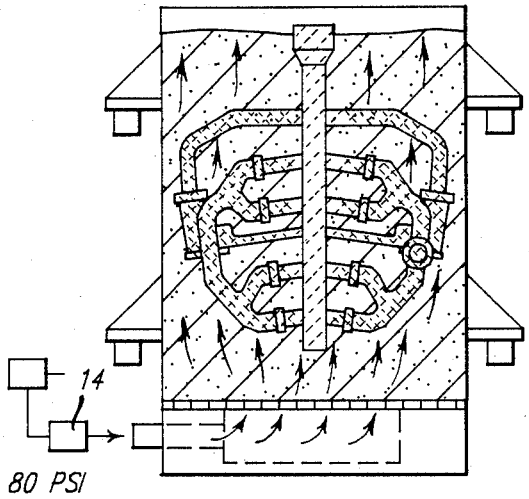

The flask 10, as shown in FIG. 1, containing the locked sand pattern cluster 17 invested therein, is then moved to a station for receiving a molten charge of metal, here being aluminum alloy SAE 331. A ceramic ladle 21 is lowered into an aluminum melt and rotated so as to draw a measured charge of molten aluminum. The molten aluminum is maintained at a temperature sufficient so that, when poured, the aluminum will be in the temperature range of 1430°–1485° F. as it reaches the downsprue 19 of the gating system 23 of the pattern cluster 17. As soon as the automatic ladle is rotated to begin the pour (see FIG. 2), a timing mechanism 15 (which is interconnected with a remote air supply purging mechanism 14) is triggered, which begins to count a time period from the initiation of molten metal pouring. The metal is funneled by a ceramic cup 22 to the entrance **23*a* of a consumable gating system 23. The molten metal vaporizes the plastic foam of the pattern gating system and flows as shown in FIG. 2. The cup 22 retains a measured supply of the molten metal to feed such flow. The actual pouring operation takes approximately 2–5 seconds (FIGS. 2–4), and the metal begins to freeze directionally from the outermost regions 24 of the pattern radially inwardly toward the gating system 23, which is centralized within the cluster 17. After about one second of pour time (as shown in FIG. 3), the molten metal has reached the casting patterns, the metal being in the temperature range of 1250°–1400° F. When the consumable pattern cluster is about 90% vaporized (as shown in FIG. 4), the molten metal in the remote regions 26 of the casting 25 may have dropped to the range of 1100°–1250° F. Hot metal 27 in the cup continues to feed the downward flow of metal to the patterns. FIG. 5 shows the pattern cluster totally displaced by the molten metal; the measured supply of molten metal receded in the cup to a level 28 commensurate with the top of the downsprue. Solidification starts in regions 26 most remote from the gating system 23 (see FIG. 6). Directional solidification continues toward the runners 23*a* gating system 23 (FIG. 7), and after about 2–5 seconds the casting 25 will be fully solidified (see FIG. 8). At about this moment, with portions of the gating system and downsprue still being molten or mushy, air purge is initiated (see FIG. 9**).

By making thermal maps utilizing several thermocouples (50–60 in number) placed throughout the mold device in the various regions of the pattern, it can be determined at what time (for a specific molten metal, its temperature, casting volume, chemistry and mold chill effectiveness) the metal will begin to solidify totally throughout the casting body but still be molten or mushy within the core metal of the gating system. Core metal is defined to mean herein the metal that is enclosed by a skin of frozen metal in any portion of the gating system. Such thermal mapping has indicated that for a 7–10 pound manifold of SAE aluminum alloy 331 containing 6.5–8% silicon, 4% copper, and about 0.5% manganese, the time period from beginning of pour to the moment when the casting is solidified, without solidification of the gating system, is approximately 3.9–5.7 minutes. During this waiting period (FIGS. 5–8), the flask with the molten aluminum contained therein is indexed to a sand conditioning station, at which time the air supply 14 is connected for eventual communication to the manifold 13 (see FIG. 5); the air supply has the capability of blowing or purging relatively cool (room temperature) air through the perforated plate 12 throughout the mold sand.

Figure 10:
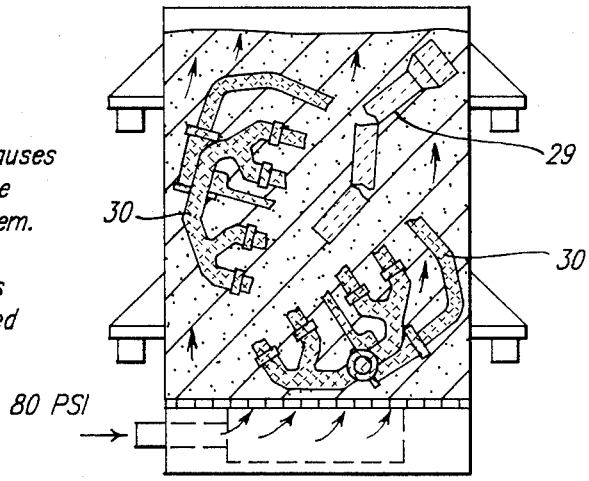

Upon expiration of the waiting period, the control valve for purge air is actuated and purge air bursts through the openings in the perforated plate (see FIG. 10). This accomplishes several functions: (i) the gaseous elements resulting from the oxidation of the polystyrene foam are exothermically oxidized by the purge air to neutral gases, water vapor, and carbon dioxide; (ii) at the same time, the gating system, which still remains molten within its core, is cooled or quenched very rapidly causing such gating system metal to disintegrate into metallic pieces 29 or beads; and (iii) the severed castings 30 and disintegrated parts 29 are stirred or moved slightly within the sand volume (see FIG. 10).

The temperature of the purge air supply should preferably be in the range of 60°–100° F. in order to create the quenching effect. In order to have this proceed as a rapid quench, the purge air must have a pressure supply which is 80–120 psi so that the air achieves the chilling effect desired while not disturbing the integrity of the castings that have already solidified. The air purge should be sufficient to create sme fluidization of the unbonded sand and thereby some dislocation of the cast pieces. Other chilling gases can be used as long as they have an oxidizing effect and do not contaminate the unbonded sand.

EXAMPLES

Three examples were prepared to test the integrity of disintegrating such nonsolidified gating system by use of purge air. In the first example, a seven pound, 1.9 liter manifold was used. The various parameters for the process are illustrated Table I, which consists of the molten metal pouring temperature, the temperature of the purge gas, the time at which the purge was applied after pouring, the pressure of the purge gas, and the period during which the purge gas was sustained. The success of severance was judged by the degree of disintegration of the gating without affecting the casting and by the length of residual gating still attached to the casting after purging.

While several examples of the invention have been illustrated and described, it will be obvious to those skilled in the art that various changes and modifications may be made without departing from the invention, and it is intended to cover in the appended claims all such changes and equivalents as fall within the true spirit and scope of the invention.

TABLE I

| Sample | | Molten | | Waiting | | | Disintegration | Length of Residual Gating |
|---|---|---|---|---|---|---|---|---|
| Casting Weight | Engine Size Identification | Metal Pouring Temp.(°F.) | Purge Air Temp.(F.°) | Period For Purge (minutes) | Duration Of Purge (seconds) | Purge Gas Pressure (psi) | of Gating Without Affecting Casting | Still Attached to Casting (inches) |
| 7 lb./1.9 Liter | | 1450 | 72 | 4 | 15 | 100 | Yes | 1½ |
| 7 lb./1.9 Liter | | 1450 | 72 | 4 | 15 | 60 | Incomplete | 3 |
| 7.5 lb./2.3 upper manifold portion | | 1450 | 100 | 6 | 15 | 100 | Some | 3½ |
| 7.5 lb./2.3 upper manifold portion | | 1450 | 100 | 2.5 | 15 | 100 | No | 0 |
| 11 lb./3.0 Liter | | 1450 | 60 | 3.2 | 20 | 100 | Yes | ⅝ |
| 11 lb./3.0 Liter | | 1450 | 60 | 4 | 5 | 100 | Incomplete | 10 |

We claim:

1. A method of degating clustered metal castings produced by ECP in which molten metal is gravity poured into a dry, unbonded sand mold for solidification, the improvement comprising:

forcing purge air through the unbonded sand mold just prior to the solidification of the core metal of the gating for said clustered metal castings, said purge air being forced thereinto at a predetermined pressure and for a period of time causing the gating to disintegrate.

2. The method of claim 1, in which the core metal is aluminum, the predetermined pressure for said purge air is in the range of 80–120 psi, and said predetermined period of time being in the range of 10–20 seconds.

3. The method of claim 1, in which the core metal is aluminum, the time period elapsed from the moment the molten metal is poured into said mold to the time at which said purge air is forced into the mold is in the range of 3–5 minutes.

4. The method of claim 3, in which the elapsed time period is adjusted to ensure that no greater than ⅝ inch protrusion of a gating stub on each of said castings remains after disintegration of the gating.

5. The method of claim 2, in which the molten metal poured into said mold is controlled to be in the temperature range of 1430°–1460° F.

6. The method of claim 1, in which the temperature of said purge air is maintained in the range of 60°–100° F.

7. The method of claim 1, in which the mold into which said molten metal is poured contains a polystyrene pattern and attached gating system which employs a central downsprue, at least the metal displacing said downsprue breaking into beads as a result of disintegration.

8. The method of claim 1, which further comprises, after completion of the purge air step, the following steps:

(a) separating the independent castings freed from said gating; and (b) severing any residual gating stubs from each of the castings that have been so separated.

9. The method as in claim 8, in which the forcing of purge air into said mold is timed to disintegrate said gating within no greater than about ⅝ inch of said casting.

10. The method as in claim 8, in which the clustered metal castings are produced by use of consumable patterns clustered about and connected to a common consumable sprue by consumable runners, said runners having opposed notches located adjacent the casting to facilitate severance of the metal runner from the casting along a predetermined cleavage plane.

11. The method as in claim 10, in which said patterns are arranged equi-angularly about said common consumable sprue with the angle between centerlines of each pattern being 45° or less.

* * * * *